US008485843B2

(12) United States Patent
Chang

(10) Patent No.: US 8,485,843 B2
(45) Date of Patent: Jul. 16, 2013

(54) ASSEMBLING TYPE TERMINAL DEVICE WITH RJ45 FEMALE TERMINAL

(76) Inventor: Nai-Chien Chang, New Taipei (TW)

( * ) Notice: Subject to any disclaimer, the term of this patent is extended or adjusted under 35 U.S.C. 154(b) by 65 days.

(21) Appl. No.: 13/346,465

(22) Filed: Jan. 9, 2012

(65) Prior Publication Data

US 2012/0190241 A1 Jul. 26, 2012

(30) Foreign Application Priority Data

Jan. 24, 2011 (TW) ..... 100201504 A

(51) Int. Cl.
*H01R 13/73* (2006.01)

(52) U.S. Cl.
USPC ..... 439/541.5; 439/620.17; 439/620.18

(58) Field of Classification Search
USPC ..... 439/620.15–620.19, 620.21–620.23, 439/541.5, 676
See application file for complete search history.

(56) References Cited

U.S. PATENT DOCUMENTS

| | | | | |
|---|---|---|---|---|
| 7,215,088 | B1 * | 5/2007 | Clark et al. | 315/294 |
| 7,427,213 | B2 * | 9/2008 | Kondou et al. | 439/541.5 |
| 7,607,939 | B2 * | 10/2009 | Moriyama et al. | 439/541.5 |
| 7,611,383 | B1 * | 11/2009 | Huang | 439/620.17 |
| 7,706,527 | B2 * | 4/2010 | Lautenschlager | 379/441 |
| 8,386,846 | B2 * | 2/2013 | Cheung | 714/14 |
| 2007/0145826 | A1 * | 6/2007 | Clark et al. | 307/11 |
| 2009/0042444 | A1 * | 2/2009 | Shimizu | 439/620.21 |

* cited by examiner

*Primary Examiner* — Gary F. Paumen
(74) *Attorney, Agent, or Firm* — Chun-Ming Shih; HDLS IPR Services

(57) ABSTRACT

An assembling type terminal device with RJ45 female terminal is disclosed for controlling the power or data connection status of a connector terminal unit by controlling the switch of a relay unit via detecting if a RJ45 female terminal unit receives the power or data.

10 Claims, 2 Drawing Sheets

ASSEMBLING TYPE TERMINAL DEVICE WITH RJ45 FEMALE TERMINAL

BACKGROUND OF THE INVENTION

1. Field of the Invention

The present invention relates to an assembling type terminal device, in particular, relates to an assembling type terminal device with RJ45 female connector 2. Description of Prior Art As the technology develops rapidly, there are more and more types of computer connectors applied in various devices, such as a RJ45 terminal, a Universal Serial Bus (USB) or an e-SATA (external SATA) terminal.

However, these aforementioned terminals are independent from each other and do not communicate with each other. For example, the power or data connection status of a RJ45 terminal cannot be used for controlling other terminals, and the RJ45 terminal cannot be used for controlling connection status of other terminals via a network, which is an issue to resolve.

SUMMARY OF THE INVENTION

In order to overcome the disadvantages of the above prior arts, an objective of the present invention is to provide an assembling type terminal device with RJ45 female terminal.

In order to overcome the disadvantages of the above prior arts, the other objective of the present invention is to provide an assembling type terminal device with RJ45 female terminal.

In order to achieve the above objective, an assembling type terminal device with RJ45 female terminal of the present invention comprises: a RJ45 female terminal unit, where the RJ45 female terminal unit comprises at least a RJ45 female terminal unit power transmission pin; a relay unit, where the relay unit is electrically connected to the RJ45 female terminal unit power transmission pin; and a connector terminal unit, where the connector terminal unit is electrically connected to the relay unit, the connector terminal unit comprises at least a connector terminal unit transmission pin, and the connector terminal unit transmission pin is electrically connected to the relay unit.

In order to achieve the other objective in the above, an assembling type terminal device with RJ45 female terminal of the present invention comprises: a RJ45 female terminal unit, the RJ45 female terminal unit comprises at least a RJ45 female terminal unit data transmission pin; a micro controller unit, where the micro controller unit is electrically connected to the RJ45 female terminal unit data transmission pin; a relay unit, where the relay unit is electrically connected to the micro controller unit; and a connector terminal unit, where the connector terminal unit is electrically connected to the relay unit, the connector terminal unit comprises at least a connector terminal unit transmission pin, and the connector terminal unit transmission pin is electrically connected to the relay unit. The micro controller unit is used for controlling the relay unit.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Embodiments are provided in the following in order to further detail the implementations of the present invention in the summary. It should be noted that objects used in the diagrams of the embodiments are provided with proportions, dimensions, deformations, displacements and details are examples and the present invention is not limited thereto and identical components in the embodiments are the given same component numbers.

Figure 1:
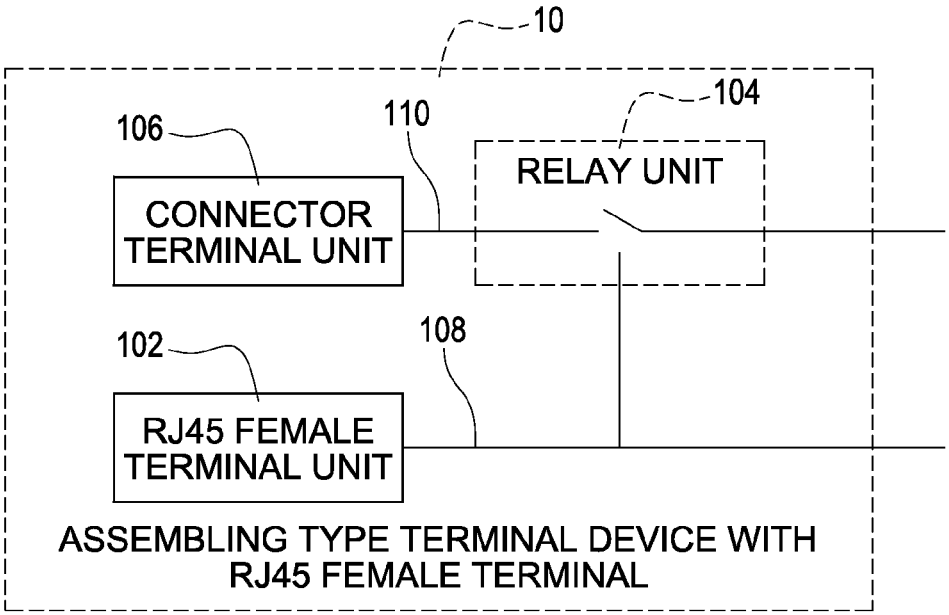
FIG. 1 is a block diagram of an assembling type terminal device with RJ45 female terminal of an embodiment according to the present invention.

FIG. 1 is a block diagram of an assembling type terminal device with RJ45 female terminal of an embodiment according to the present invention. The assembling type terminal device with RJ45 female terminal 10 of the present invention comprises a RJ45 female terminal unit 102, a relay unit 104 and a connector terminal unit 106. The relay unit 104 is electrically connected to the RJ45 female terminal unit 102 and the connector terminal unit 106.

The RJ45 female terminal unit 102 comprises at least a RJ45 female terminal unit power transmission pin 108. The connector terminal unit 106 comprises at least a connector terminal unit transmission pin 110. The relay unit 104 is electrically connected to the RJ45 female terminal unit power transmission pin 108 and the connector terminal unit transmission pin 110.

The relay unit 104 is an electromagnetic type relay used for controlling a switch via power. The connector terminal unit transmission pin 110 is used for power or data transmission. The connector terminal unit 106, for example, is a Universal Serial Bus (USB) or an e-SATA (external SATA) terminal, or any other electronic terminal.

The present invention uses power over Ethernet (PoE) technologies. When power is sent to the power transmission pin 108 of the RJ45 female terminal unit, the relay unit 104 turns on, and the connector terminal unit 106 receives external power or data from the connector terminal unit transmission pin 110. Similarly, when power is not connected to the power transmission pin 108 of the RJ45 female terminal unit, the relay unit 104 turns off, and the connector terminal unit 106 does not receive external power or data from the connector terminal unit transmission pin 110. Thus, the connection status of the connector terminal unit 106 is controlled by the power transmission status to the RJ45 female terminal unit 102.

The embodiment of the above embodiment has only one connector terminal unit 106, but the present invention is not limited to the above embodiment. An embodiment of the present invention may comprises multiple connector terminal units 106 depending on the design requirement. Also, these connector terminal units 106 are disposed with the RJ45 female terminal unit 102 in a stack or in parallel.

Figure 2:
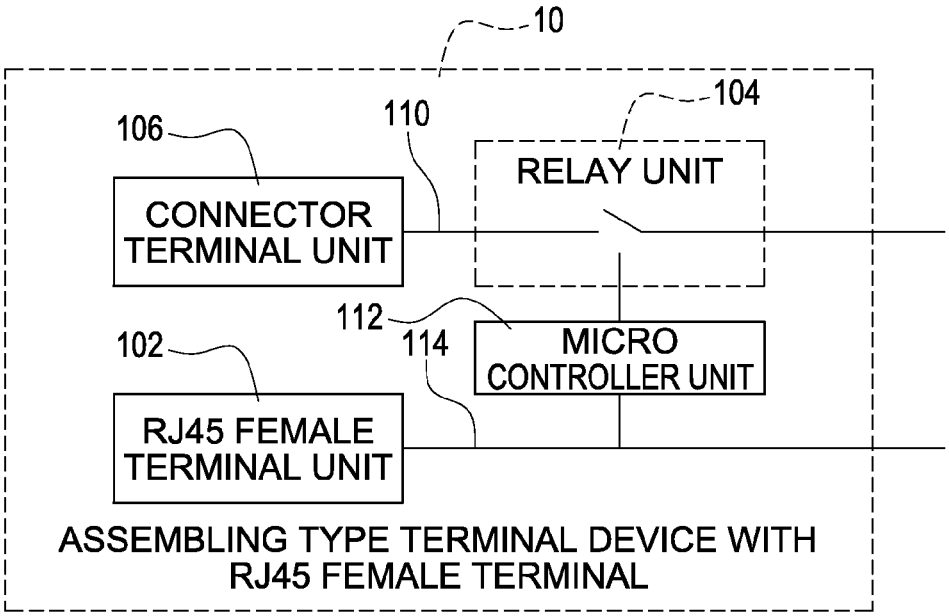
FIG. 2 is a block diagram of an assembling type terminal device with RJ45 female terminal of the other embodiment according to the present invention.

FIG. 2 is a block diagram of an assembling type terminal device with RJ45 female terminal of the other embodiment according to the present invention. The assembling type terminal device with RJ45 female terminal 10 of the present invention comprises a RJ45 female terminal unit 102, a relay unit 104, a connector terminal unit 106 and a micro controller unit 112. The relay unit 104 is electrically connected to the micro controller unit 112 and the connector terminal unit 106. The RJ45 female terminal unit 102 is electrically connected to the micro controller unit 112.

The RJ45 female terminal unit 102 comprises at least a RJ45 female terminal unit data transmission pin 114. The micro controller unit 112 is electrically connected to the RJ45 female terminal unit data transmission pin 114. The connector terminal unit 106 comprises at least a connector terminal unit transmission pin 110. The connector terminal unit transmission pin 110 is electrically connected to the relay unit 104.

The relay unit 104 is a electronic relay and the connection status is controlled the micro controller unit 112. The connector terminal unit transmission pin 110 is used for power or data transmission. The connector terminal unit 106, for example, is a Universal Serial Bus (USB) or an e-SATA (external SATA) terminal, or any other electronic terminal.

The present invention uses power over Ethernet (PoE) technologies. When data is sent to the data transmission pin 114 of the RJ45 female terminal unit, the micro controller unit 112 controls to turn on the relay unit 104, and the connector terminal unit 106 receives external power or data from the connector terminal unit transmission pin 110. Similarly, When data is not sent to the data transmission pin 114 of the RJ45 female terminal unit, the micro controller unit 112 controls to turn off the relay unit 104, and the connector terminal unit 106 does not receive external power or data from the connector terminal unit transmission pin 110. Thus, the connection status of the connector terminal unit 106 is controlled by the data transmission status to the RJ45 female terminal unit 102.

The embodiment of the above embodiment has only one connector terminal unit 106, but the present invention is not limited to the above embodiment. An embodiment of the present invention may comprise multiple connector terminal units 106 depending on the design requirement. Also, these connector terminal units 106 are disposed with the RJ45 female terminal unit 102 in a stack or in parallel.

Figure 3:
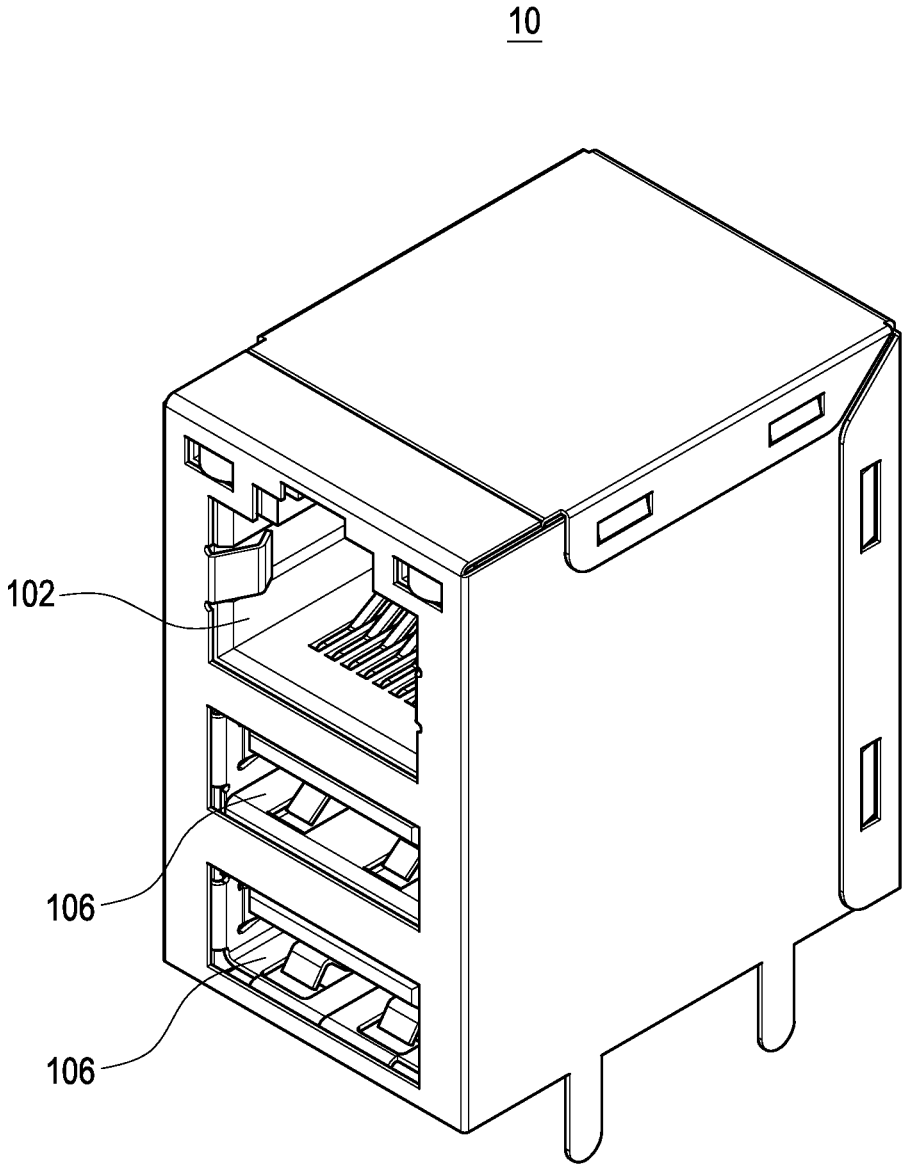
FIG. 3 is an appearance figure of an assembling type terminal device with RJ45 female terminal of an embodiment according to the present invention.

FIG. 3 is an appearance figure of an assembling type terminal device with RJ45 female terminal of an embodiment according to the present invention.

As the skilled person will appreciate, various changes and modifications can be made to the described embodiments. It is intended to include all such variations, modifications and equivalents which fall within the scope of the invention, as defined in the accompanying claims.

What is claimed is:

1. An assembling type terminal device with RJ45 female terminal, comprising:

a RJ45 female terminal unit, where the RJ45 female terminal unit comprises at least a RJ45 female terminal unit power transmission pin;

a relay unit, where the relay unit is electrically connected to the RJ45 female terminal unit power transmission pin; and a connector terminal unit, where the connector terminal unit is electrically connected to the relay unit, the connector terminal unit comprises at least a connector terminal unit transmission pin, and the connector terminal unit transmission pin is electrically connected to the relay unit.

2. The assembling type terminal device with RJ45 female terminal of claim 1, wherein the relay unit is an electronic relay.

3. The assembling type terminal device with RJ45 female terminal of claim 2, wherein the connector terminal unit transmission pin is used for transmission power.

4. The assembling type terminal device with RJ45 female terminal of claim 2, wherein the connector terminal unit transmission pin is used for transmission data.

5. The assembling type terminal device with RJ45 female terminal of claim 2, wherein the connector terminal unit is a Universal Serial Bus (USB) or an e-SATA (external SATA) terminal.

6. An assembling type terminal device with RJ45 female terminal, comprising:

a RJ45 female terminal unit, the RJ45 female terminal unit comprises at least a RJ45 female terminal unit data transmission pin;

a micro controller unit, where the micro controller unit is electrically connected to the RJ45 female terminal unit data transmission pin;

a relay unit, where the relay unit is electrically connected to the micro controller unit; and a connector terminal unit, where the connector terminal unit is electrically connected to the relay unit, the connector terminal unit comprises at least a connector terminal unit transmission pin, and the connector terminal unit transmission pin is electrically connected to the relay unit, wherein the micro controller unit is used for controlling the relay unit.

7. The assembling type terminal device with RJ45 female terminal of claim 6, wherein the relay unit is an electronic relay.

8. The assembling type terminal device with RJ45 female terminal of claim 7, wherein the connector terminal unit transmission pin is used for power transmission.

9. The assembling type terminal device with RJ45 female terminal of claim 7, wherein the connector terminal unit transmission pin is used for data transmission.

10. The assembling type terminal device with RJ45 female terminal of claim 7, wherein the connector terminal unit is a Universal Serial Bus (USB) or an e-SATA (external SATA) terminal.

* * * * *